US012523238B1

(12) United States Patent
Li

(10) Patent No.: US 12,523,238 B1
(45) Date of Patent: Jan. 13, 2026

(54) LINE-CONTROLLED AIR PUMP FOR MULTI-CHAMBER INFLATABLE PRODUCTS AND CONTROL METHOD THEREOF

(71) Applicant: WangLi Plastic & Electronics (Huizhou) Co., Ltd., Huizhou (CN)

(72) Inventor: Yonghe Li, Huizhou (CN)

(73) Assignee: WANGLI PLASTIC & ELECTRONICS (HUIZHOU) CO., LTD., Huizhou (CN)

( * ) Notice: Subject to any disclaimer, the term of this patent is extended or adjusted under 35 U.S.C. 154(b) by 0 days.

(21) Appl. No.: 19/006,424

(22) Filed: Dec. 31, 2024

(30) Foreign Application Priority Data

Jul. 12, 2024 (CN) ..... 202410934176.8

(51) Int. Cl.
*F04D 29/46* (2006.01)
*F04D 25/08* (2006.01)
*F04D 27/00* (2006.01)

(52) U.S. Cl.
CPC ..... *F04D 29/462* (2013.01); *F04D 27/001* (2013.01); *F04D 25/08* (2013.01)

(58) Field of Classification Search
CPC .... F04D 25/084; F04D 29/503; F04D 25/166; F04D 25/0673; F04D 29/601; F04D 25/06; F04D 25/08
See application file for complete search history.

(56) References Cited

U.S. PATENT DOCUMENTS

2015/0164236 A1* 6/2015 Driscoll, Jr. ..... A47C 27/083 5/713

FOREIGN PATENT DOCUMENTS

CN 207145273 U 3/2018
CN 209875430 U 12/2019

* cited by examiner

*Primary Examiner* — Brian O Peters
(74) *Attorney, Agent, or Firm* — MUNCY, GEISSLER, OLDS & LOWE, P.C.

(57) ABSTRACT

A line-controlled air pump for multi-chamber inflatable products includes an L-shaped switching pipe movably disposed inside the air pump and a pressure sensor configured to detect pressure data of the inflatable product. When the pressure sensor detects that the pressure data has risen to the preset first threshold, inflation of each secondary chamber of the inflatable product suspends while inflation of the main chamber maintains. When the pressure sensor detects that the pressure data has risen to a preset second threshold, the control system stops inflation of the main chamber of the inflatable product, while the control system continues inflation of each secondary chamber. When the pressure sensor detects that the pressure data has risen to a preset third threshold, the control system stops inflation of both the main chamber and each secondary chamber.

16 Claims, 9 Drawing Sheets

LINE-CONTROLLED AIR PUMP FOR MULTI-CHAMBER INFLATABLE PRODUCTS AND CONTROL METHOD THEREOF

CROSS REFERENCE TO RELATED APPLICATIONS

The present application claims priority from Chinese Application No. CN 202410934176.8 filed on Jul. 12, 2024, all of which are hereby incorporated herein by reference.

TECHNICAL FIELD

The present disclosure relates to the technical field of air pumps for inflatable products, and more particularly to a line-controlled air pump for multi-chamber inflatable products and a control method thereof.

BACKGROUND

In the prior art, air pumps are commonly used in conjunction with inflatable products, with the air pump installed within the inflatable product to achieve automatic inflation. Some large inflatable products have fixed air pumps with inflation ports. During inflation, the inflation port is opened to allow the air pump to inflate the internal cavity of the inflatable product. After inflation is complete, the inflation port is closed to prevent air leakage from the inflatable product. When deflation of the inflatable product is required, the deflation function of the air pump can be activated to automatically discharge the air from inside the inflatable product. With increasing market demand, inflatable products with a plurality of chambers have become increasingly common, such as inflatable sofas, inflatable beds, inflatable dolls, and inflatable boats composed of a plurality of inflatable bodies. Such products typically designate the largest volume portion as the main chamber, with the remaining smaller volume portions serving as secondary chambers. Before use, the main chamber and each secondary chamber are required to be inflated separately until appropriate expansion is achieved for normal use. Conversely, during disassembly, the main chamber and each secondary chamber are required to be deflated separately before the inflatable product can be disassembled and stored.

However, current approaches for inflatable products with a plurality of chambers mostly involve installing separate air pumps for each chamber to perform inflation and deflation. This method results in a high number of air pumps installed in a single inflatable product, leading to high costs. While some inflatable products are equipped with only one air pump, these pumps have a plurality of internal air flow channels and relatively complex structures. Furthermore, during inflation control, they simply inflate all chambers simultaneously until completion, failing to consider the significant volume difference between the main chamber and secondary chambers as an important factor. This often results in situations where the secondary chambers become over-expanded while the main chamber remains insufficiently inflated, forcing the air pump to continue outputting air to the entire inflatable product. This inflation method is often detrimental to the service life of the secondary chambers in the inflatable product and, in severe cases, may lead to rupture of the secondary chambers.

SUMMARY

In view of the above, the present disclosure provides a line-controlled air pump for multi-chamber inflatable products and a control method thereof, which enables the air pump to achieve inflation and deflation of a plurality of chambers in the inflatable product with a simple structure. Moreover, the air method considers the significant volume difference between the main chamber and secondary chambers, thereby avoiding over-expansion of the smaller secondary chambers during inflation of the main chamber and secondary chambers of the inflatable product.

According to one aspect of the present disclosure, a line-controlled air pump for multi-chamber inflatable products is provided, which includes: an installation shell configured to be embedded within a cavity of the inflatable product, a fan and a control system disposed within the installation shell, and an external air port formed on a side of the installation shell exposed outside the inflatable product;

a main chamber supply port and a plurality of secondary chamber supply ports formed on a side of the installation shell within the inflatable product cavity, and a main chamber valve and secondary chamber valves respectively provided for the main chamber supply port and secondary chamber supply ports;

an L-shaped switching pipe movably disposed within the installation shell and controlled by the control system, wherein one end of the L-shaped switching pipe is simultaneously connected with the main chamber supply port and each secondary chamber supply port, and the other end is selectively connectable to the suction end and discharge end of the fan through different displacement positions;

a pressure sensor disposed within the installation shell, wherein the control system is configured to detect pressure data of the inflatable product through the pressure sensor;

when the L-shaped switching pipe is connected to the discharge end of the fan, external air successively passes through the external air port and L-shaped switching pipe and respectively enters the main chamber supply port and each secondary chamber supply port to inflate the main chamber and each secondary chamber of the inflatable product; and when the L-shaped switching pipe is connected to the suction end of the fan, air from the main chamber and each secondary chamber of the inflatable product respectively passes through the main chamber supply port and each secondary chamber supply port, enters the L-shaped switching pipe, and discharges through the external air port.

According to another aspect of the present disclosure, a method for controlling the above-described air pump is provided, when inflation of the main chamber and all secondary chambers of the inflatable product is required, the control system is configured to: open the main chamber valve and secondary chamber valves, activate the fan, and control the L-shaped switching pipe's displacement position to connect it to the fan's discharge end, thereby driving external air to enter the air pump through the external air port and pass through the L-shaped switching pipe to respectively enter the main chamber supply port and each secondary chamber supply port, thereby inflating the main chamber and each secondary chamber of the inflatable product through the main chamber supply port and each secondary chamber supply port;

during inflation, when the pressure sensor detects that the pressure data has risen to a preset first threshold, the control system is configured to: close each secondary chamber valve to suspend inflation of each secondary chamber of the inflatable product, while maintaining the main chamber valve in an open state to continue inflation of the main chamber of the inflatable product; and when the pressure sensor detects that the pressure data has risen to a preset second threshold, the control system is configured to: close the main chamber valve to stop inflation of the main chamber of the inflatable product, while reopening each secondary chamber valve to continue inflation of each secondary chamber of the inflatable product;

when the pressure sensor detects that the pressure data has again risen to the preset second threshold or reached a preset third threshold, the control system is configured to: stop the fan and close each secondary chamber valve to stop inflation of both the main chamber and each secondary chamber of the inflatable product.

BRIEF DESCRIPTION OF THE DRAWINGS

To more clearly illustrate the technical solutions of the present disclosure or the prior art, the drawings needed in the description of the embodiments or the prior art will be briefly introduced below.

DETAILED DESCRIPTION OF THE EMBODIMENTS

The preferred embodiments of the present disclosure will be described in detail below, with examples of the embodiments shown in the accompanying drawings.

Figure 1:
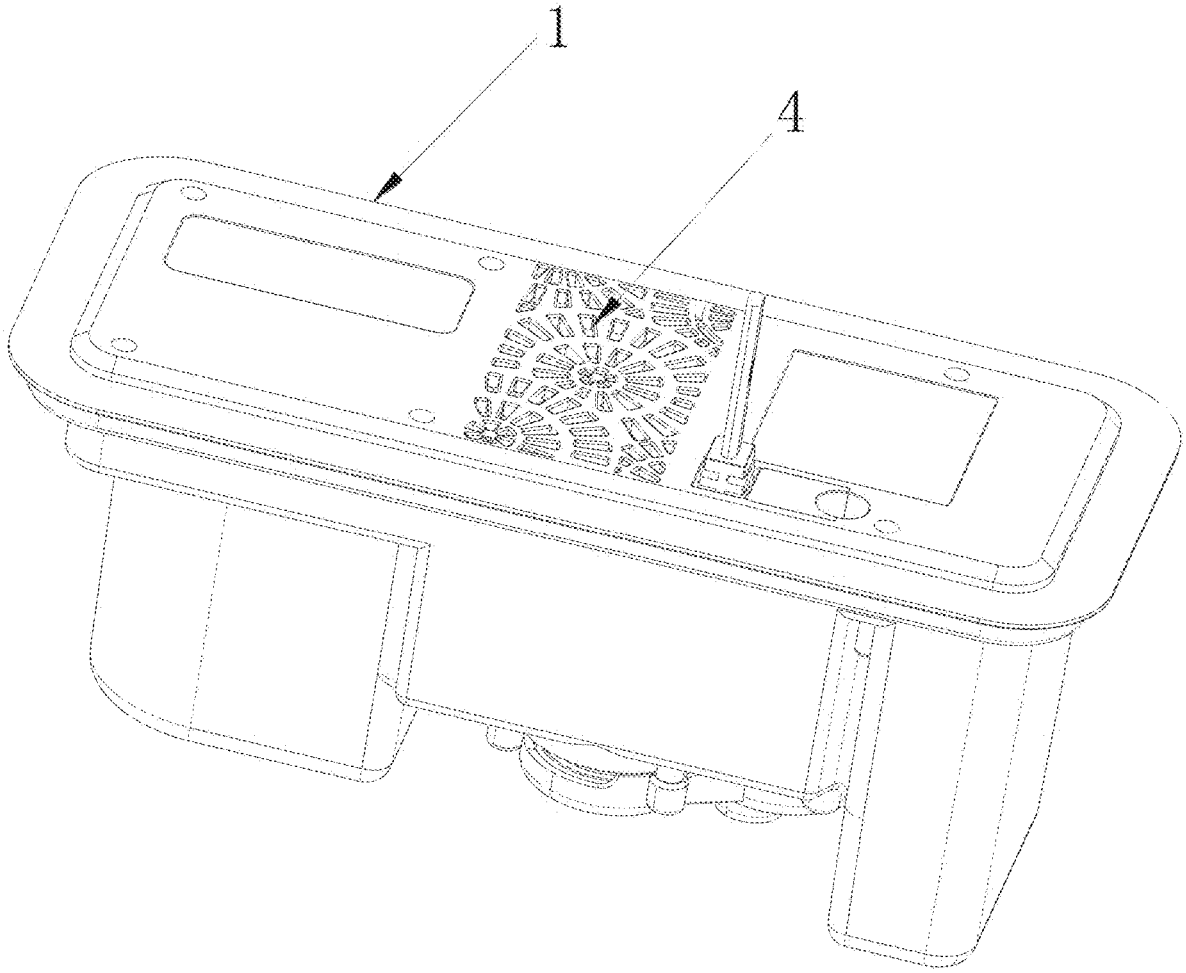
FIG. 1 is an external structural view of an air pump according to an embodiment of the present disclosure.
Figure 2:
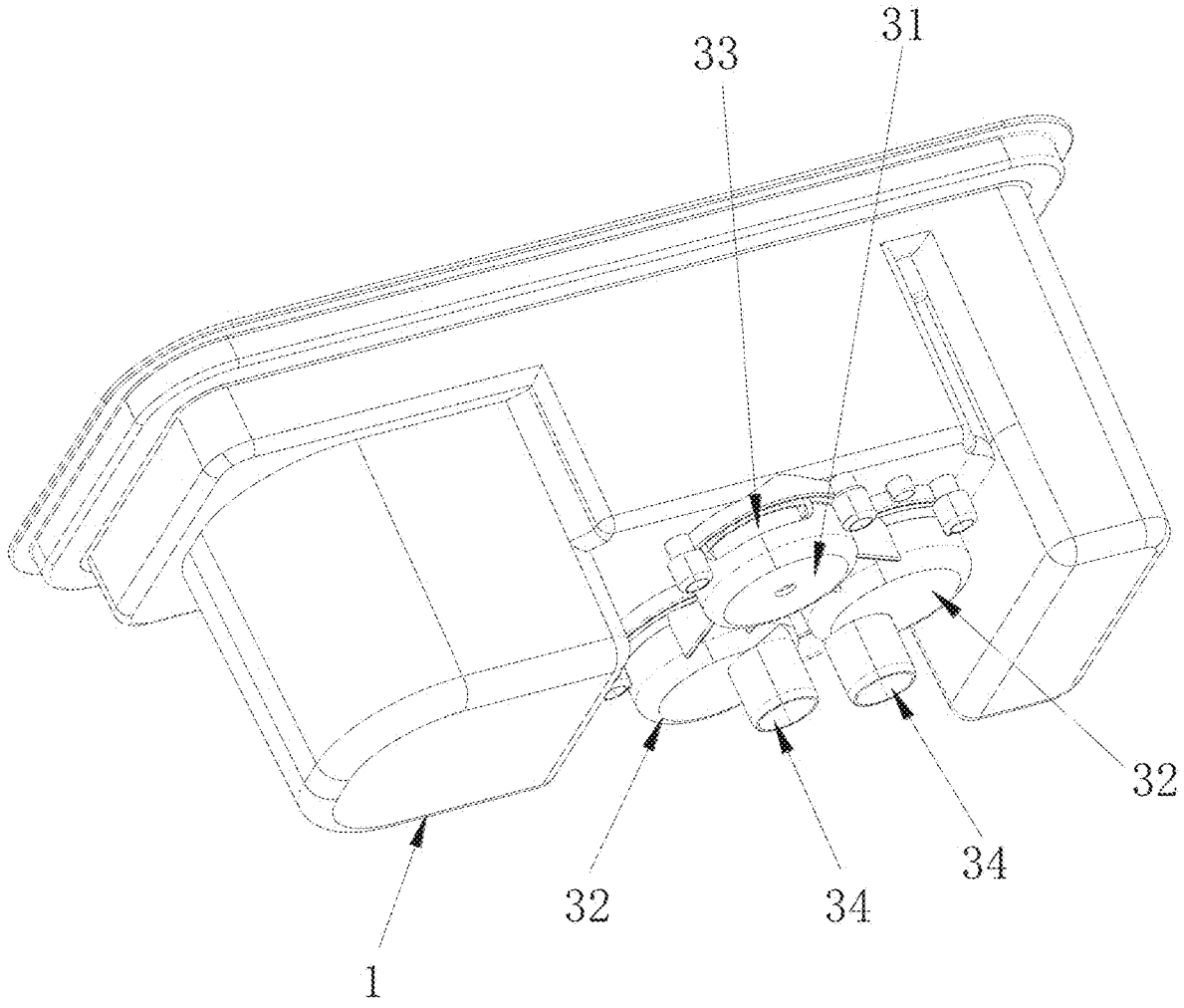
FIG. 2 is a bottom structural view of FIG. 1.
Figure 3:
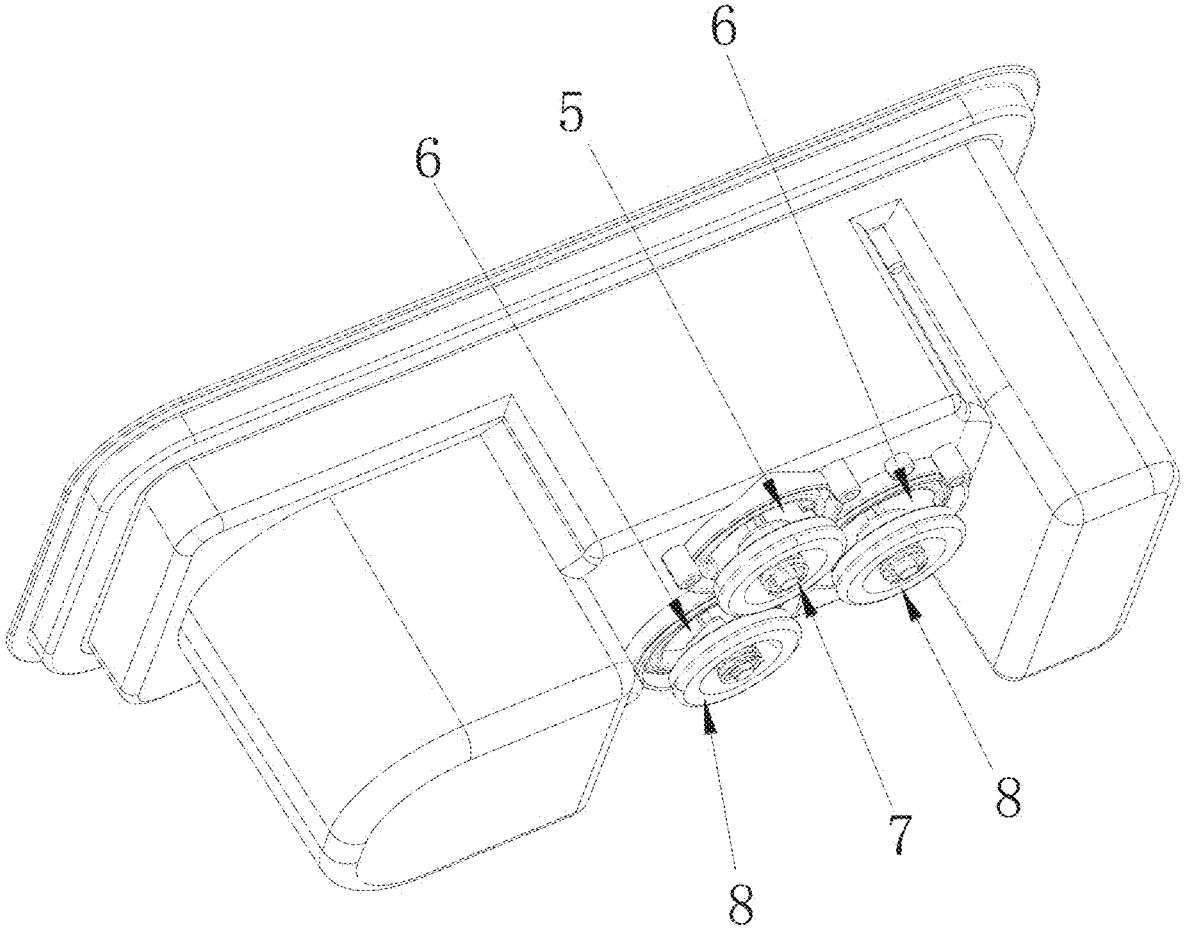
FIG. 3 is another bottom structural view of FIG. 1 with some parts omitted.
Figure 4:
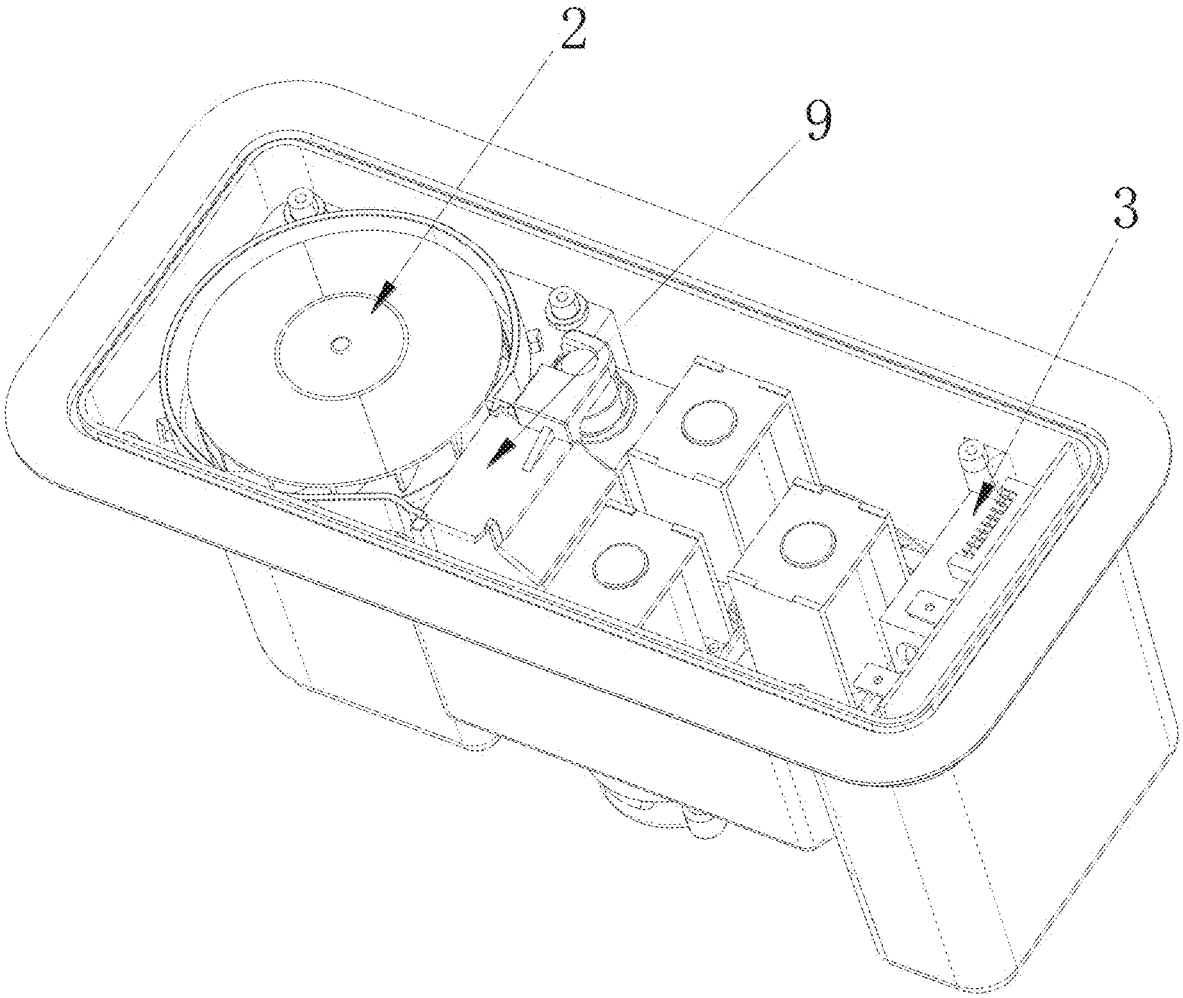
FIG. 4 is an internal structural view of FIG. 1, with a top cover of an installation shell hidden.
Figure 5:
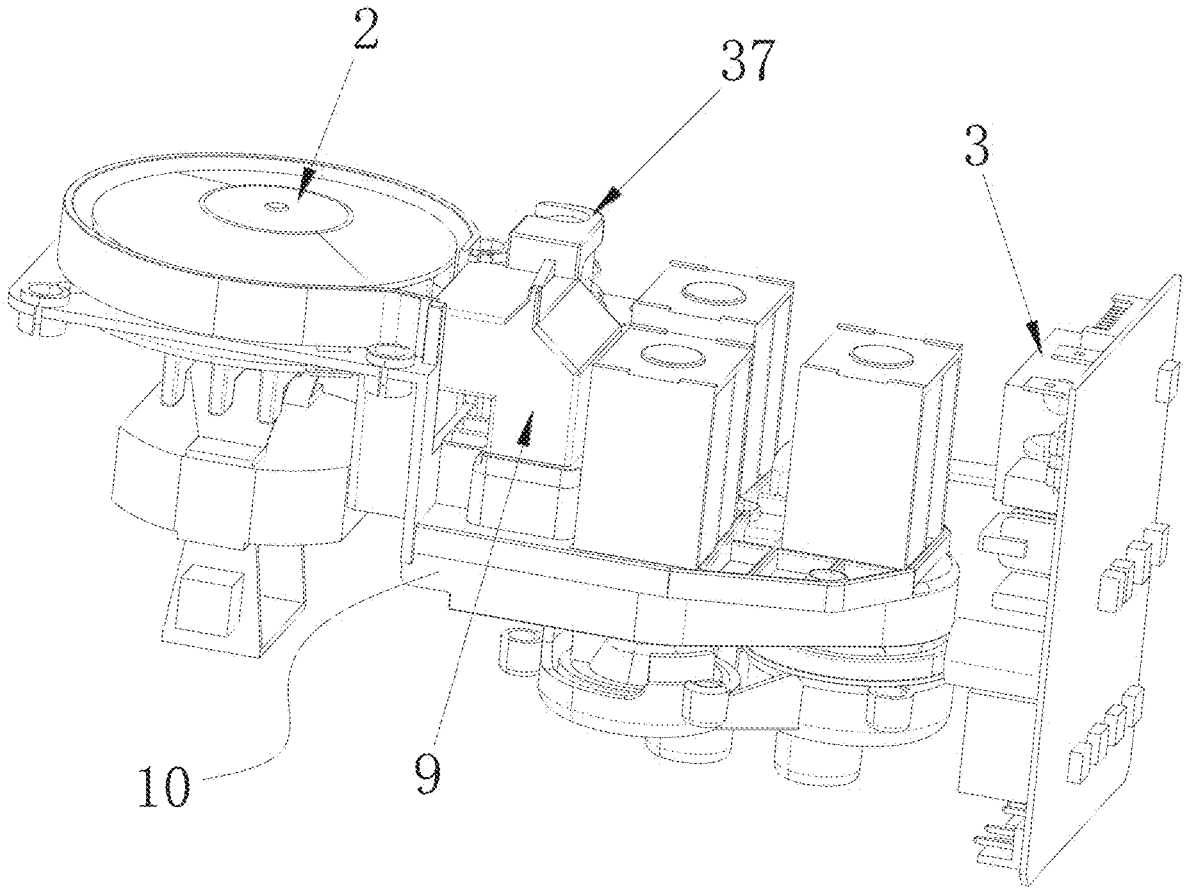
FIG. 5 is another internal structural view of FIG. 1, with the installation shell hidden.

Referring to FIG. 1, there is provided a line-controlled air pump for multi-chamber inflatable products, comprising an installation shell 1 configured to be fixedly embedded within the cavity of the inflatable product. The installation shell 1 includes an external air port 4 exposed on one side of the inflatable product, allowing external air to enter the interior of the air pump installation shell 1, or allowing air from inside the inflatable product to be discharged to the exterior through the external air port 4 of the air pump. Referring to FIGS. 2-4, the installation shell 1 internally houses a fan 2 and a control system 3 (FIG. 4), and the bottom of the installation shell 1 is provided with one main chamber supply port 5 and two secondary chamber supply ports 6. The main chamber supply port 5 and the two secondary chamber supply ports 6 are all positioned within the cavity of the inflatable product (FIG. 3). The main chamber supply port 5 is fitted with a main nozzle 31, and the secondary chamber supply ports 6 are respectively fitted with secondary nozzles 32 (FIG. 2). As shown in FIG. 2, the main nozzle 31 has an opening 33 on one side, and the main nozzle 31 is positioned within the main chamber of the inflatable product, thereby allowing the internal cavity of the main chamber to exchange air with the interior of the air pump installation shell 1 through the opening 33 of the main nozzle 31. The bottoms of the two secondary nozzles 32 are each provided with a respective connecting tube 34 for fitting flexible tubes (not shown in the figures). The other ends of the flexible tubes are configured to connect to the secondary chambers of the inflatable product, thereby allowing the internal cavities of the various secondary chambers to exchange air with the interior of the air pump installation shell 1 through the flexible tubes and connecting tubes 34. To control the opening and closing of the various supply ports of the air pump, the main chamber supply port 5 and secondary chamber supply ports 6 are respectively equipped with main chamber valve 7 and secondary chamber valves 8 (FIG. 3). Additionally, as shown in FIG. 5, the installation shell 1 includes a movably installed L-shaped switching pipe 9, the movement of which is controlled by the control system 3. The bottom end of the L-shaped switching pipe 9 is simultaneously connected with the main chamber supply port 5 and each secondary chamber supply port 6, while the top left end of the L-shaped switching pipe 9 is selectively connectable to the suction end and discharge end of the fan 2 through different displacement positions. Furthermore, the installation shell 1 is equipped with a pressure sensor (not shown in the figures), whereby the control system 3 is configured to detect pressure data of the inflatable product through the pressure sensor. During operation, when the L-shaped switching pipe 9 is connected to the discharge end of the fan 2, the fan 2 is configured to draw external air through the external air port 4 into the interior of the air pump installation shell 1. The external air successively passes through the external air port 4 and L-shaped switching pipe 9 and then respectively enters the main chamber supply port 5 and each secondary chamber supply port 6, thereby inflating the main chamber and each secondary chamber of the inflatable product. Conversely, when the L-shaped switching pipe 9 is connected to the suction end of the fan 2, the fan 2 draws internal air from the inflatable product through the L-shaped switching pipe 9. The air from the main chamber and each secondary chamber of the inflatable product respectively passes through the main chamber supply port 5 and each secondary chamber supply port 6 to enter the interior of the air pump installation shell 1, and continues through the L-shaped switching pipe 9 and external air port 4 to discharge to the exterior.

According to the line-controlled air pump of the present embodiment, there is provided an L-shaped switching pipe 9 that is movably disposed within the installation shell 1. This L-shaped switching pipe 9 is configured to be controlled to move by the control system 3. Since one end of the L-shaped switching pipe 9 is simultaneously connected with the main chamber supply port 5 and each secondary chamber supply port 6, the main chamber and each secondary chamber of the inflatable product can be simultaneously connected with the L-shaped switching pipe 9 through the main chamber supply port 5 and each secondary chamber supply port 6 of the air pump installation shell. Additionally, since the other end of the L-shaped switching pipe 9 is selectively connectable to the suction end and discharge end of the fan 2 through different displacement positions of the L-shaped switching pipe 9, the L-shaped switching pipe 9 can be moved between different positions to selectively connect with the suction end and discharge end of the fan 2. Therefore, by controlling the L-shaped switching pipe 9 to switch between different working positions through the control system 3, the suction end and discharge end of the fan 2 can selectively act on the interior of the L-shaped switching pipe 9. When controlling the L-shaped switching pipe 9 to move to a position connecting to the discharge end of the fan 2, the fan 2 is configured to input air into the interior of the L-shaped switching pipe 9, thereby allowing air to simultaneously enter the main chamber supply port 5 and each secondary chamber supply port 6 through the L-shaped switching pipe 9, thus achieving simultaneous inflation of each chamber of the inflatable product. Conversely, when controlling the L-shaped switching pipe 9 to move to a position connecting with the suction end of the fan 2, the fan 2 is configured to draw air from the interior of the L-shaped switching pipe 9, thereby drawing out the air from inside each chamber of the inflatable product through the main chamber supply port 5 and each secondary chamber supply port 6. In other words, the present disclosure achieves inflation and deflation of the main chamber and all secondary chambers of the inflatable product by switching the working position of the L-shaped switching pipe 9 inside the air pump, using a simple structure to achieve inflation and deflation of a plurality of chambers in the inflatable product.

Figure 6:
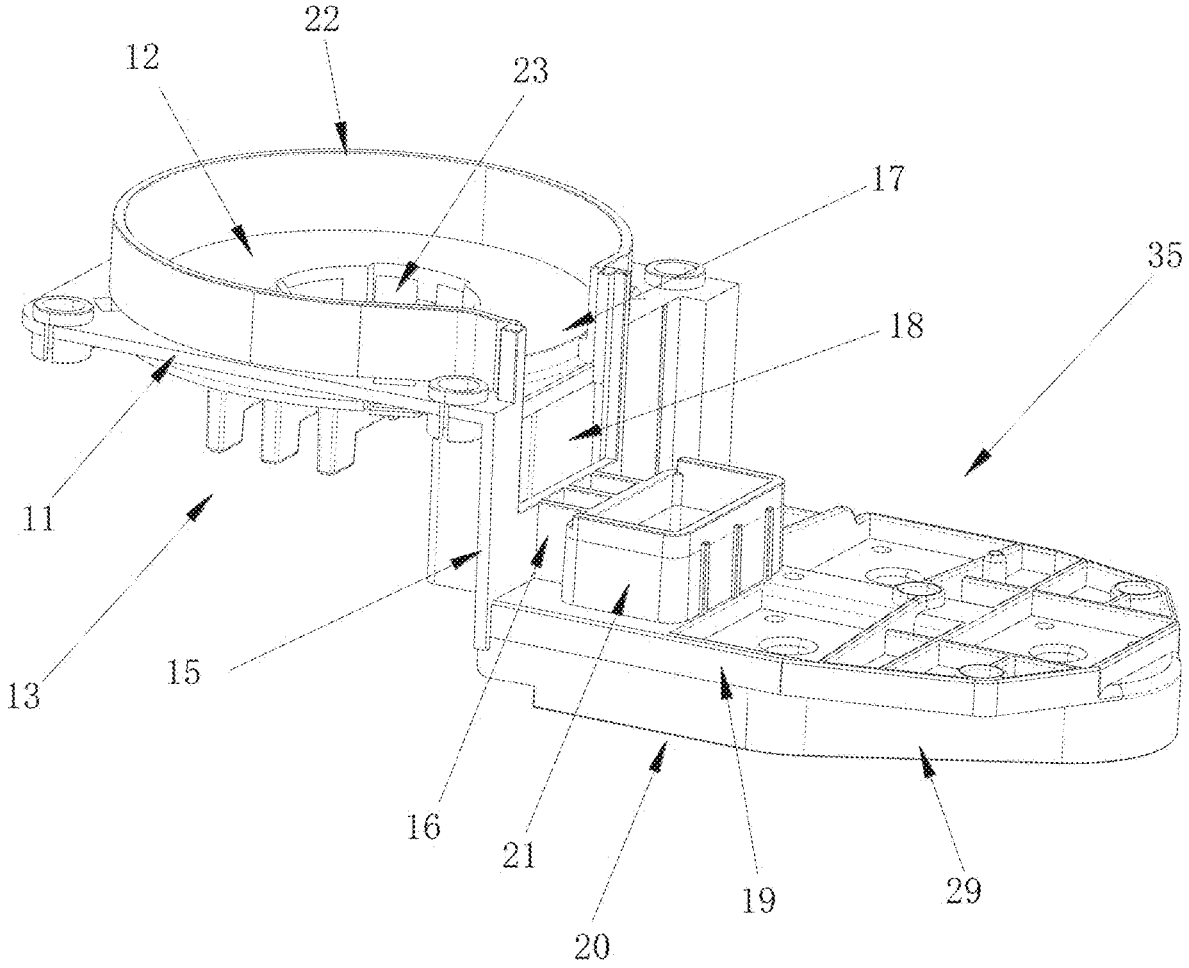
FIG. 6 is a structural view of a Z-shaped partition board according to an embodiment of the present disclosure.
Figure 7:
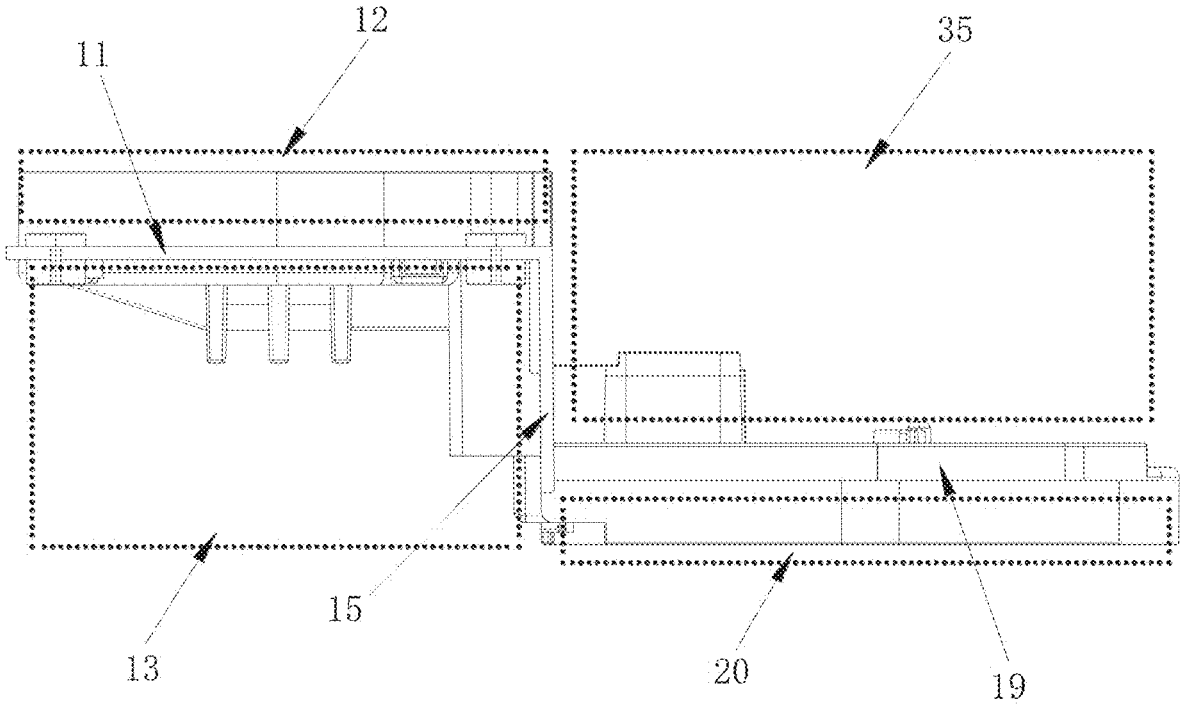
FIG. 7 is a structural schematic diagram showing the division of the interior of the air pump installation shell into a blowing chamber, a suction chamber, a collection chamber, and an exchange chamber by the Z-shaped partition board.

In the embodiment shown in FIG. 5, the installation shell 1 comprises a fixedly installed Z-shaped partition board 10, which primarily serves to divide the internal space of the installation shell 1 into a plurality of distinct chambers. Referring to FIGS. 6 and 7, the Z-shaped partition board 10 includes an upper horizontal board 11 at the top and a lower horizontal board 19 at the bottom, with a vertically extending middle vertical board 15 interconnecting the upper horizontal board 11 and lower horizontal board 19. Within the installation shell 1, the upper and lower sides of the upper horizontal board 11 respectively divide the interior of the installation shell 1 into a blowing chamber 12 and a suction chamber 13. The right side of the middle vertical board 15 defines an exchange chamber 35 within the installation shell 1, with the exchange chamber 35 being positioned above the lower horizontal board 19. The blowing chamber 12 and exchange chamber 35, as well as the suction chamber 13 and exchange chamber 35, are respectively separated by the middle vertical board 15. Furthermore, the external air port 4 is connected with the exchange chamber 35, and the middle vertical board 15 is provided with an inflation port 17 and a discharge port 18. The inflation port 17 is connected with the blowing chamber 12, the discharge port 18 is connected with the suction chamber 13, and the top left end of the L-shaped switching pipe 9 is selectively connectable with the discharge port 18 and inflation port 17 through different displacement positions. Further referring to FIG. 8, the fan 2 includes a centrifugal impeller 14 mounted in the blowing chamber 12, with the suction end at the center of the centrifugal impeller 14 being connected with the suction chamber 13, allowing the suction end at the center of the centrifugal impeller 14 to draw air from the suction chamber 13 when the centrifugal impeller 14 rotates, causing the air from the suction chamber 13 to enter the blowing chamber 12. Therefore, when inflation of the inflatable product is required, the control system 3 controls the L-shaped switching pipe 9 to move to a position connecting to the inflation port 17, while simultaneously activating the fan 2 to drive the centrifugal impeller 14 located in the blowing chamber 12 to rotate. The suction end at the center of the centrifugal impeller 14 continuously draws air from the suction chamber 13, thereby creating negative pressure inside the suction chamber 13. Consequently, external air naturally enters the exchange chamber 35 inside the air pump through the external air port 4 and enters the suction chamber 13 through the discharge port 18 in the middle vertical board 15, thus allowing external air to continuously enter the suction chamber 13. The centrifugal impeller 14 then drives the air entering the blowing chamber 12 through the inflation port 17 into the L-shaped switching pipe 9, delivering the air to the main chamber supply port 5 and each secondary chamber supply port 6 at the bottom of the air pump, thereby successfully achieving inflation of the main chamber and each secondary chamber of the inflatable product. Conversely, when deflation of the inflatable product is required, the control system 3 controls the L-shaped switching pipe 9 to move to a position connecting with the discharge port 18, while simultaneously activating the fan 2 to drive the centrifugal impeller 14 located in the blowing chamber 12 to rotate. At this time, since the suction chamber 13 and L-shaped switching pipe 9 are in fluid communication through the discharge port 18, when the suction end at the center of the centrifugal impeller 14 continuously draws air from the suction chamber 13, it creates negative pressure simultaneously in the suction chamber 13 and inside the L-shaped switching pipe 9. As a result, the air from each chamber of the inflatable product naturally enters the interior of the air pump through the main chamber supply port 5 and each secondary chamber supply port 6 at the bottom of the air pump, and subsequently flows through the L-shaped switching pipe 9 and suction chamber 13 to enter the blowing chamber 12, subsequently entering the exchange chamber 35 through the inflation port 17 on the side of the blowing chamber 12, and finally discharging to the exterior through the external air port 4 of the air pump, successfully achieving deflation of the main chamber and each secondary chamber of the inflatable product.

Figure 11:
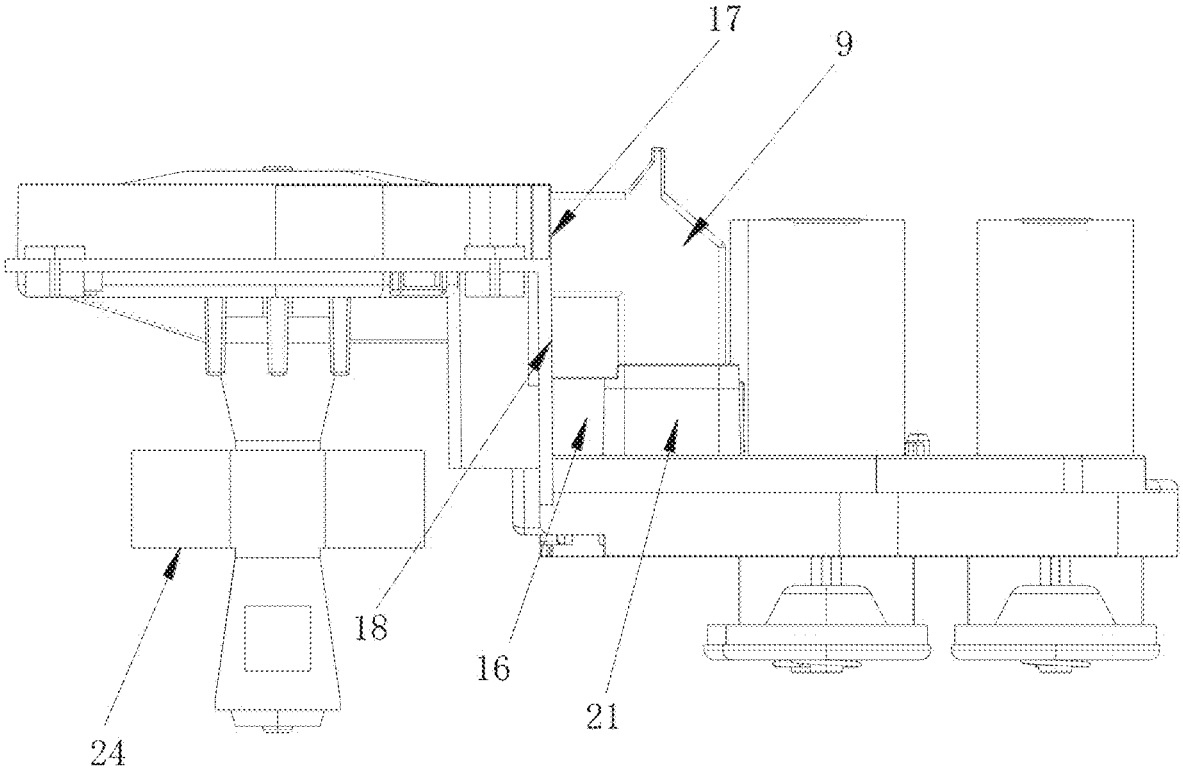
FIG. 11 is a schematic view showing an L-shaped switching pipe connected to the inflation port.
Figure 12:
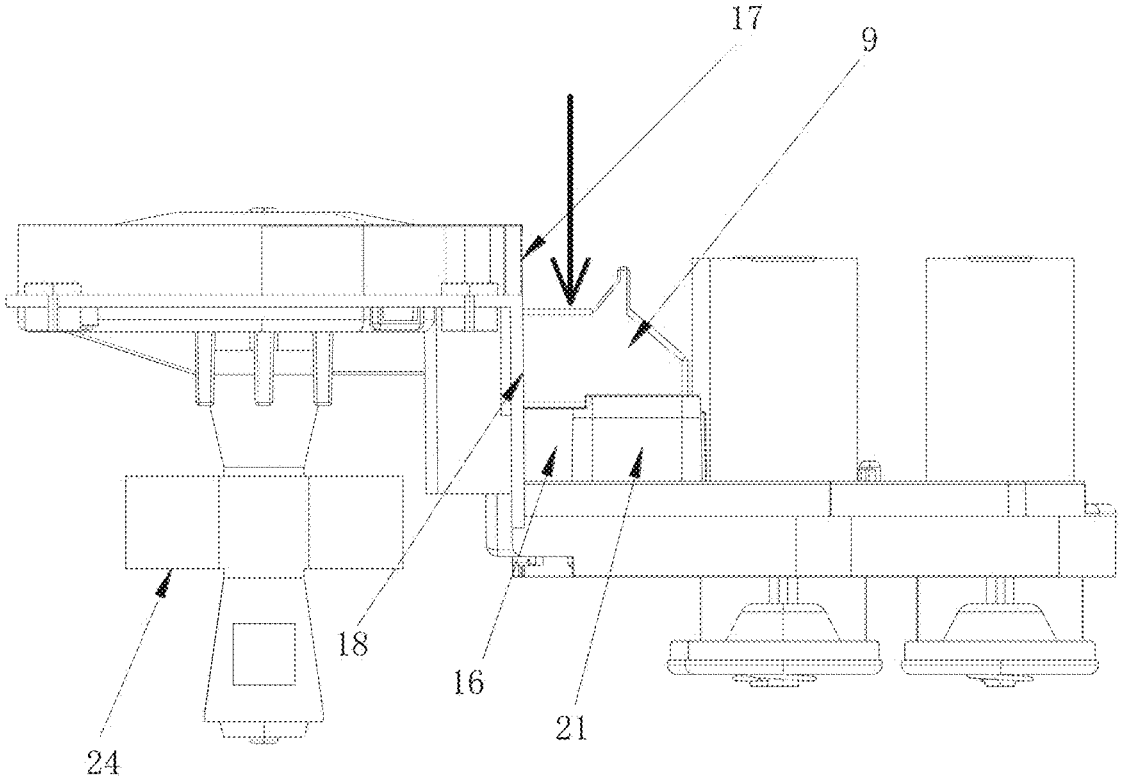
FIG. 12 is a schematic view showing the L-shaped switching pipe connected to the discharge port.

In one embodiment, as shown in FIGS. 6 and 7, the lower side of the lower horizontal board 19 defines a collection chamber 20 within the installation shell 1, with the main chamber supply port 5 and each secondary chamber supply port 6 at the bottom of the air pump being simultaneously connected with the collection chamber 20. Furthermore, the lower horizontal board 19 comprises a vertical tube 21 integrally formed therewith, with the lower end of the vertical tube 21 being connected with the collection chamber 20. Referring to FIGS. 11 and 12, during assembly, the lower end of the L-shaped switching pipe 9 is slidably received within the vertical tube 21 and is connected with the collection chamber 20, thereby allowing the L-shaped switching pipe 9 to perform linear reciprocating movement along the vertical tube 21. Since the inflation port 17 and discharge port 18 are linearly arranged along the extension direction of the vertical tube 21, the L-shaped switching pipe 9 is configured to perform linear reciprocating movement along the vertical tube 21 to different positions, thereby allowing the top left end of the L-shaped switching pipe 9 to selectively connect with the inflation port 17 and discharge port 18. In this structure, since the lower end of the L-shaped switching pipe 9 slidably fits within the vertical tube 21 and connects to the collection chamber 20, this arrangement not only ensures the stability of the L-shaped switching pipe 9 during movement but also ensures that the L-shaped switching pipe 9 maintains connection with the collection chamber 20 during movement, ensuring that during inflation or deflation, the various chambers of the inflatable product can connect to the L-shaped switching pipe 9 through the collection chamber 20.

Optionally, to facilitate accurate detection of the inflatable product's air pressure during inflation or deflation processes, the pressure sensor may be installed within the interior of the L-shaped switching pipe 9 or the collection chamber 20.

According to the embodiment shown in FIGS. 5-7, to ensure that the top of the upper horizontal board 11 of the Z-shaped partition board 10 properly defines the blowing chamber 12 within the installation shell 1, the top of the upper horizontal board 11 also comprises a first annular board 22 integrally formed therewith. The first annular board 22 extends vertically to the top inner wall of the installation shell 1 and, together with the inner wall of the installation shell 1, encloses to define the blowing chamber 12, thereby establishing the blowing chamber 12 within the installation shell 1. Furthermore, the edges of the upper horizontal board 11 and middle vertical board 15 respectively extend to the inner wall of the installation shell 1 to facilitate enclosing the suction chamber 13 together with the inner wall of the installation shell 1.

Figure 8:
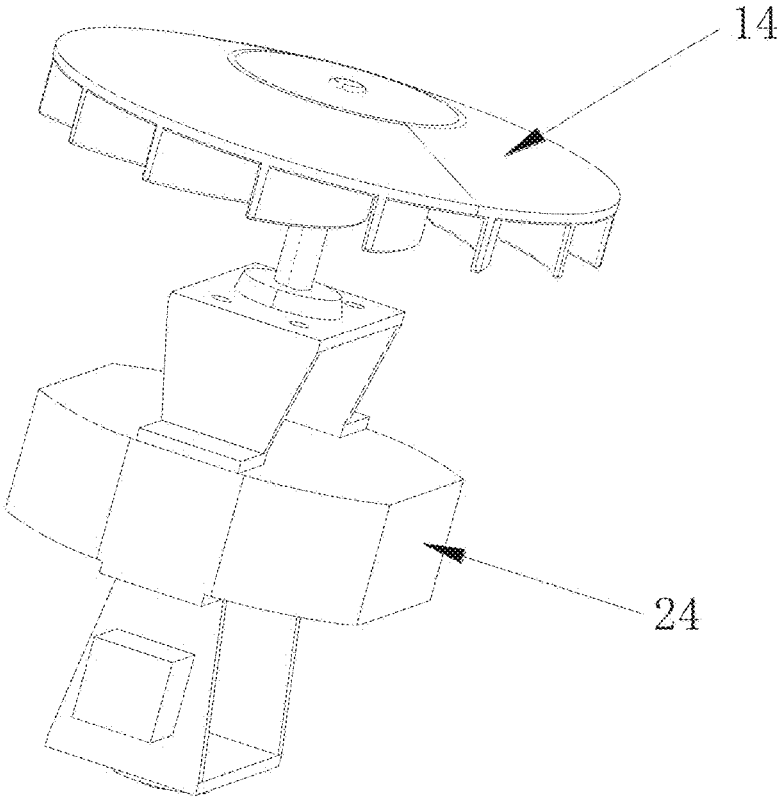
FIG. 8 is a structural view of a fan according to an embodiment of the present disclosure.

Additionally, the upper horizontal board 11 is provided with a communication hole 23 providing fluid communication between the blowing chamber 12 and suction chamber 13, thereby allowing the suction end at the center of the centrifugal impeller 14 to be connected with the suction chamber 13. Referring to FIG. 8, the fan 2 also includes a motor 24, with the motor 24 and centrifugal impeller 14 being respectively positioned in the suction chamber 13 and blowing chamber 12 and being coaxially connected through the communication hole 23.

Figure 9:
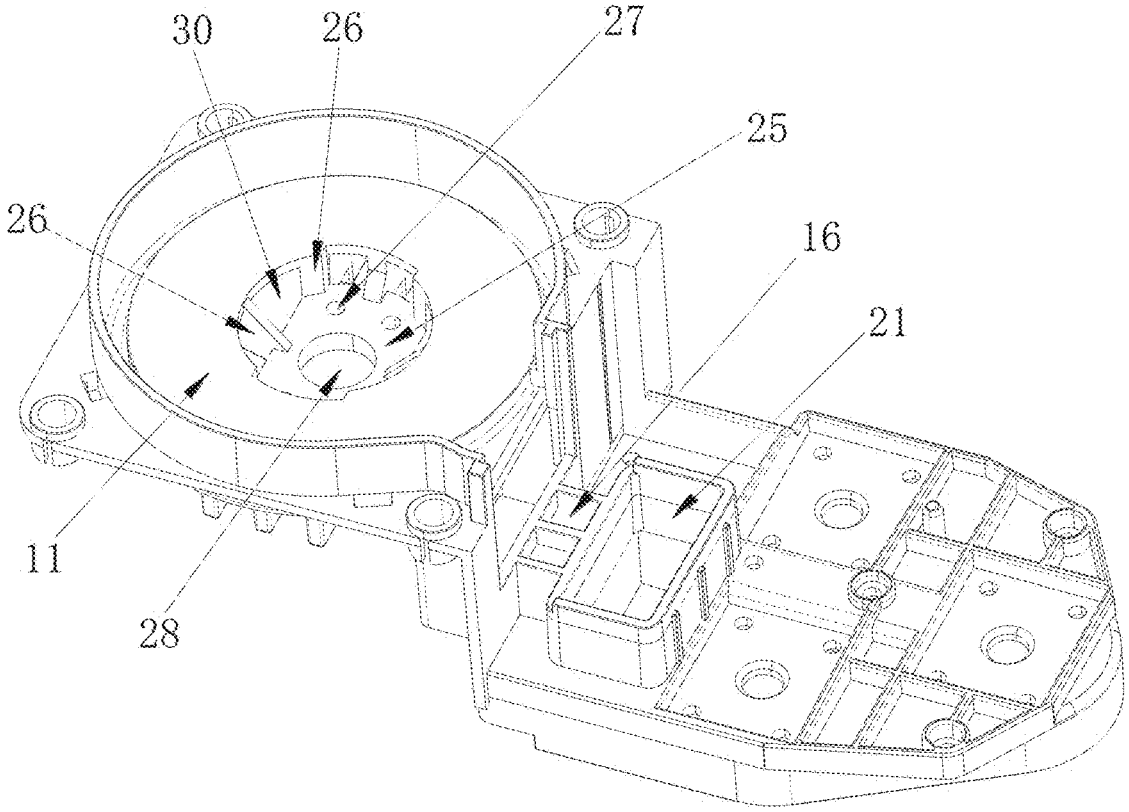
FIG. 9 is another structural view of the Z-shaped partition board in FIG. 6.

Specifically, referring to FIG. 9, to facilitate the mounting and fixing of the motor 24, a motor mounting plate 25 is provided within the suction chamber 13. The motor mounting plate 25 is provided with a plurality of screw holes 27 for connecting the motor 24, and the motor mounting plate 25 is also provided with a shaft hole 28 configured for the output shaft of the motor 24 to pass through. The position of the motor mounting plate 25 corresponds to the communication hole 23, and the motor mounting plate 25 is spaced at a predetermined distance from the bottom of the upper horizontal board 11. To ensure the fixing of the motor mounting plate 25, a plurality of connecting plates 26 are fixedly connected between the upper horizontal board 11 and the motor mounting plate 25. The various connecting plates 26 are arranged around the center axis of the communication hole 23 and spaced with predetermined gaps 30 between each other, thereby allowing air exchange between the suction chamber 13 and blowing chamber 12 through these various gaps 30.

Specifically, as shown in FIG. 6, the bottom of the lower horizontal board 19 comprises a second annular board 29 integrally formed therewith. The second annular board 29 extends vertically downward to the inner wall of the installation shell 1 to define the collection chamber 20 together with the inner wall of the installation shell 1.

Furthermore, the upper portion of the lower horizontal board 19 comprises a supplemental tube 16 integrally formed therewith, with the exchange chamber 35 and suction chamber 13 being in fluid communication through the supplemental tube 16. Specifically, the lower port of the supplemental tube 16 is connected with the suction chamber 13, while the upper port of the supplemental tube 16 is positioned within and is connected with the exchange chamber 35. When the L-shaped switching pipe 9 is connected with the inflation port 17, the upper port of the supplemental tube 16 remains in an open state. Therefore, when the air pump is inflating the inflatable product, external air entering the exchange chamber 35 through the external air port 4 can not only enter the suction chamber 13 through the discharge port 18 in the middle vertical board 15 but can also simultaneously enter the suction chamber 13 through the supplemental tube 16, thereby ensuring that external air can more fully enter the suction chamber 13, thus helping to improve the inflation efficiency of the air pump for the inflatable product. Conversely, when the L-shaped switching pipe 9 is connected with the discharge port 18, that is, when the air pump is deflating the inflatable product, the bottom surface of the L-shaped switching pipe 9 covers and seals the upper port of the supplemental tube 16. This prevents air entering the suction chamber 13 from the L-shaped switching pipe 9 from directly escaping to the exchange chamber 35 through the supplemental tube 16, thereby ensuring that the deflated air in the suction chamber 13 can be efficiently discharged externally under the active drive of the centrifugal impeller 14, thus ensuring the deflation efficiency of the air pump for the inflatable product.

Figure 10:
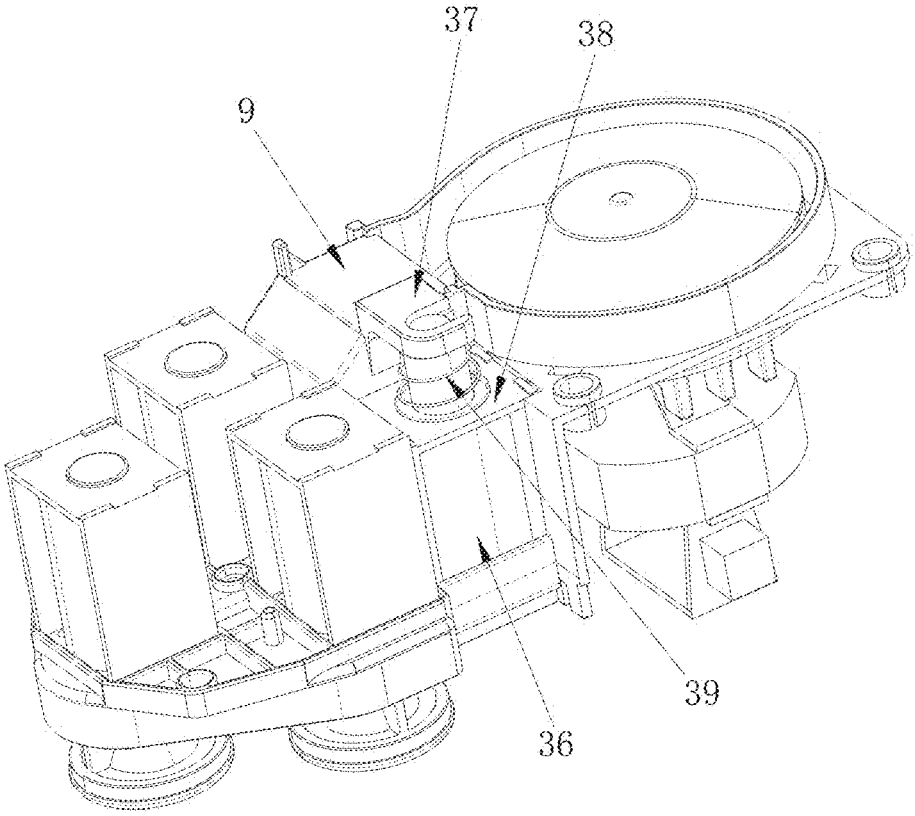
FIG. 10 is another internal structural view of FIG. 1.

As shown in FIG. 10, the installation shell 1 of the air pump further comprises an electromagnetic switch 36 controlled by the control system 3 of the air pump. The bottom of the electromagnetic switch 36 is fixed to the lower horizontal board 19 of the Z-shaped partition board 10, while the top of the L-shaped switching pipe 9 comprises a hook 37 integrally formed therewith. The hook 37 engages with the extendable end at the top of the electromagnetic switch 36, thereby allowing the electromagnetic switch 36 to drive the movement of the L-shaped switching pipe 9. Furthermore, a mounting plate 38 is provided on the lower horizontal board 19, with the extendable end of the electromagnetic switch 36 passing upward through a hole in the mounting plate 38 to engage with the hook 37. A spring 39 is provided between the top of the mounting plate 38 and the bottom of the hook 37, with the spring 39 being fitted over the extendable end of the electromagnetic switch 36. When the electromagnetic switch 36 is energized, its extendable end pulls the hook 37 and consequently the entire L-shaped switching pipe 9 downward, thereby compressing the spring 39 at this position. The L-shaped switching pipe 9 maintains a position connected with the discharge port 18, facilitating deflation of the inflatable product. When the electromagnetic switch 36 is de-energized, under the restoration force of the spring 39, the hook 37 moves the L-shaped switching pipe 9 back upward to its original position, establishing fluid communication with the inflation port 17 to facilitate inflation of the inflatable product. Thus, the working positions of the L-shaped switching pipe 9 within the installation shell 1 can be readily switched.

Below is a description of the control method for the air pump described in the above embodiment.

When using the air pump of the above embodiment to inflate the main chamber and all secondary chambers of the inflatable product, the following steps are executed.

The control system 3 opens the main chamber valve 7 and secondary chamber valves 8 and activates the fan 2, while simultaneously controlling the movement of the L-shaped switching pipe 9 to establish fluid communication with the discharge end of the fan 2, that is, to establish fluid communication between the L-shaped switching pipe 9 and the inflation port 17. This drives external air to successively enter the exchange chamber 35, suction chamber 13, and blowing chamber 12 of the air pump interior through the external air port 4, and then through the L-shaped switching pipe 9 to respectively enter the main chamber supply port 5 and each secondary chamber supply port 6.

During the inflation process, when the pressure sensor detects that the pressure data has risen to a preset first threshold, the control system 3 closes each secondary chamber valve 8 to suspend inflation of each secondary chamber of the inflatable product, while the control system 3 maintains the main chamber valve 7 in an open state to continue inflation of the main chamber of the inflatable product.

When the pressure sensor detects that the pressure data has risen to a preset second threshold, the control system 3 closes the main chamber valve 7 to stop inflation of the main chamber of the inflatable product, while the control system 3 reopens each secondary chamber valve 8 to continue inflation of each secondary chamber of the inflatable product.

When the pressure sensor detects that the pressure data has risen to a preset third threshold, the control system 3 stops the fan 2 and closes each secondary chamber valve 8, thereby stopping inflation of both the main chamber and each secondary chamber of the inflatable product.

According to the control method in this embodiment, when inflation of the main chamber and all secondary chambers of the inflatable product is required, the control system 3 opens the main chamber valve 7 and secondary chamber valves 8, activates the fan 2, and controls the displacement position of the L-shaped switching pipe 9 to establish fluid communication with the discharge end of fan 2. This process drives external air to enter the air pump interior through the external air port 4 and through the L-shaped switching pipe 9 to respectively enter the main chamber supply port 5 and each secondary chamber supply port 6, thereby inflating the main chamber and each secondary chamber of the inflatable product through the main chamber supply port 5 and each secondary chamber supply port 6. To account for the significant volume difference between the main chamber and secondary chambers of the inflatable product, the control system of the air pump preset first threshold, second threshold, and third threshold values. During inflation, when the pressure sensor detects that the pressure data has risen to the preset first threshold, the control system 3 closes each secondary chamber valve 8 while maintaining the main chamber valve 7 in an open state, suspending inflation of each secondary chamber of the inflatable product while maintaining inflation of the main chamber. This means that after the various chambers have been inflated to a certain degree ensuring that all chambers of the inflatable product have been opened by the input air, inflation of the smaller-volume secondary chambers is temporarily stopped to prevent over-expansion of the secondary chambers of the inflatable product, while continuing inflation of the larger-volume main chamber. When the pressure sensor detects that the pressure data has risen to the preset second threshold, indicating that the main chamber of the inflatable product has reached sufficient expansion, the control system 3 closes the main chamber valve 7 and opens each secondary chamber valve 8, stopping inflation of the main chamber and allowing the air pump to continue inflating the not-yet-fully-expanded secondary chambers. This prevents over-expansion of the secondary chambers of the inflatable product. Finally, when the pressure sensor detects that the pressure data has risen to the preset third threshold, the control system 3 stops the fan 2 and closes each secondary chamber valve 8, stopping inflation of both the main chamber and each secondary chamber of the inflatable product, maintaining the chambers in their expanded state for normal use.

When using the air pump of this embodiment to deflate the main chamber and all secondary chambers of the inflatable product, he control system 3 opens the main chamber valve 7 and secondary chamber valves 8 and activates the fan 2, while simultaneously switching the displacement position of the L-shaped switching pipe 9 to establish fluid communication with the suction end of the fan 2, that is, to establish fluid communication between the L-shaped switching pipe 9 and the discharge port 18. This drives air from the main chamber and each secondary chamber of the inflatable product to enter the L-shaped switching pipe 9 through the main chamber supply port 5 and each secondary chamber supply port 6, and successively enter the suction chamber 13, blowing chamber 12, and exchange chamber 35 inside the air pump, finally discharging through the external air port 4 of the air pump.

When the pressure sensor detects that the pressure data has dropped to a preset fourth threshold, the control system 3 closes the main chamber valve 7 and secondary chamber valves 8 and stops the fan 2.

Thus, complete deflation of all chambers of the inflatable product can be achieved through the above method.

According to one implementation mode, after inflation is complete and continued adjustment to increase the air pressure in the main chamber or secondary chambers of the inflatable product is needed, the following steps are executed.

The control system 3 activates the fan 2 and switches the displacement position of the L-shaped switching pipe 9 to establish fluid communication with the discharge end of the fan 2, that is, to establish fluid communication between the L-shaped switching pipe 9 and the inflation port 17, and opens the main chamber valve 7 or secondary chamber valves 8. The fan 2 drives external air through the L-shaped switching pipe 9 to enter the main chamber supply port 5 or secondary chamber supply ports 6, inflating the main chamber or secondary chambers of the inflatable product. After inflation is complete, the control system 3 stops the fan 2 and closes the main chamber valve 7 or secondary chamber valves 8.

After inflation is complete and adjustment to decrease the air pressure in the main chamber or secondary chambers of the inflatable product is needed, the following steps are executed.

The control system 3 opens the main chamber valve 7 or secondary chamber valves 8, allowing air from the main chamber or secondary chambers of the inflatable product to enter the air pump interior through the L-shaped switching pipe 9 and naturally discharge through the external air port 4. Advantageously, since the fan 2 does not need to be activated during this process, this method provides enhanced energy efficiency and environmental benefits.

Finally, it should be noted that the above embodiments are provided solely to illustrate the technical solutions of the present disclosure, and the scope of protection is not limited thereto. Any simple modifications or equivalent replacements of the technical features of these embodiments all fall within the protection scope of the present disclosure.

What is claimed is:

1. A line-controlled air pump for multi-chamber inflatable products, comprising:

an installation shell embedded within a cavity of the inflatable products, in which a fan and a control system are disposed, and an external air port formed on a side of the installation shell exposed outside the inflatable products;

a main chamber supply port and a plurality of secondary chamber supply ports formed on a side of the installation shell inside the inflatable product cavity, and a main chamber valve and secondary chamber valves respectively provided for the main chamber supply port and secondary chamber supply ports;

an L-shaped switching pipe movably disposed within the installation shell and controlled by the control system, with one end thereof simultaneously connected with the main chamber supply port and each secondary chamber supply port, and the other end thereof selectively connectable to a suction end and a discharge end of the fan through different displacement positions;

a pressure sensor disposed within the installation shell, through which pressure data of the inflatable products is detected by the control system;

wherein with the L-shaped switching pipe connected to the discharge end of the fan, the fan is configured to drive external air successively to pass through the external air port and L-shaped switching pipe and respectively enter the main chamber supply port and each secondary chamber supply port to inflate the main chamber and each secondary chamber of the inflatable product;

wherein with the L-shaped switching pipe connected to the suction end of the fan, the fan is configurated to drive air from the main chamber and each secondary chamber of the inflatable product to respectively pass through the main chamber supply port and each secondary chamber supply port and enter the L-shaped switching pipe, and is finally discharged through the external air port;

the installation shell is provided with a Z-shaped partition board including an upper horizontal board and a lower horizontal board, with a vertically extending middle vertical board interconnecting the upper horizontal board and lower horizontal board;

wherein the upper horizontal board respectively divide the interior of the installation shell into a blowing chamber and a suction chamber located at opposite sides of the upper horizontal board, and a side of the middle vertical board defines an exchange chamber within the installation shell, with the blowing chamber and exchange chamber, as well as the suction chamber and exchange chamber respectively separated by the middle vertical board;

wherein the external air port is connected with the exchange chamber, the middle vertical board is provided with an inflation port connected with the blowing chamber and a discharge port connected with the suction chamber, and the L-shaped switching pipe is selectively connectable with the discharge port and inflation port through different displacement positions;

wherein the fan includes a centrifugal impeller mounted in the blowing chamber, with a suction end at a center of the centrifugal impeller being connected with the suction chamber;

wherein a side of the lower horizontal board away from the exchange chamber defines a collection chamber within the installation shell, with the main chamber supply port and each secondary chamber supply port being simultaneously connected with the collection chamber;

wherein the lower horizontal board comprises a vertical tube connected with the collection chamber, and the inflation port and discharge port are linearly arranged along an extension direction of the vertical tube;

wherein one end of the L-shaped switching pipe is slidably received within the vertical tube and is connected with the collection chamber to allow the L-shaped switching pipe to perform linear reciprocating movement along the vertical tube to different positions so as to make the other end of the L-shaped switching pipe selectively connect with the inflation port and discharge port, and wherein a bottom of the lower horizontal board is integrally formed with a second annular board, which extends vertically to an inner wall of the installation shell to define the collection chamber together with the inner wall of the installation shell.

2. The line-controlled air pump according to claim 1, wherein a top of the upper horizontal board is integrally formed with a first annular board, which extends vertically to an inner wall of the installation shell and encloses to define the blowing chamber together with the inner wall of the installation shell, and the upper horizontal board is provided with a communication hole in fluid communication with the blowing chamber and suction chamber; and wherein the fan further includes a motor, the motor and centrifugal impeller are respectively positioned in the suction chamber and blowing chamber and are coaxially connected through the communication hole.

3. The line-controlled air pump according to claim 2, wherein a motor mounting plate corresponding to the communication hole is provided within the suction chamber, which is spaced at a predetermined distance from a bottom of the upper horizontal board;

wherein a plurality of connecting plates are fixedly connected between the upper horizontal board and the motor mounting plate, which are arranged around a center axis of the communication hole and spaced with a predetermined gap between each other; and wherein the motor mounting plate is provided with a plurality of screw holes, and a shaft hole configured for an output shaft of the motor to pass through.

4. The line-controlled air pump according to claim 1, wherein the lower horizontal board is integrally formed with a supplemental tube, through which the exchange chamber is in fluid communication with the suction chamber;

wherein when the L-shaped switching pipe is connected with the inflation port, a port of the supplemental tube within the exchange chamber is in an open state, and when the L-shaped switching pipe is connected with the discharge port, a bottom surface of the L-shaped switching pipe covers and seals the port of the supplemental tube within exchange chamber.

5. A line-controlled air pump for multi-chamber inflatable products, comprising:

an installation shell embedded within a cavity of the inflatable products, in which a fan and a control system are disposed, and an external air port formed on a side of the installation shell exposed outside the inflatable products;

a main chamber supply port and a plurality of secondary chamber supply ports formed on a side of the installation shell inside the inflatable product cavity, and a main chamber valve and secondary chamber valves respectively provided for the main chamber supply port and secondary chamber supply ports;

an L-shaped switching pipe movably disposed within the installation shell and controlled by the control system, with one end thereof simultaneously connected with the main chamber supply port and each secondary chamber supply port, and the other end thereof selectively connectable to a suction end and a discharge end of the fan through different displacement positions;

a pressure sensor disposed within the installation shell, through which pressure data of the inflatable products is detected by the control system;

wherein with the L-shaped switching pipe connected to the discharge end of the fan, the fan is configurated to drive external air successively to pass through the external air port and L-shaped switching pipe and respectively enter the main chamber supply port and each secondary chamber supply port to inflate the main chamber and each secondary chamber of the inflatable product;

wherein with the L-shaped switching pipe connected to the suction end of the fan, the fan is configured to drive air from the main chamber and each secondary chamber of the inflatable product to respectively pass through the main chamber supply port and each secondary chamber supply port and enter the L-shaped switching pipe, and is finally discharged through the external air port;

the installation shell is provided with a Z-shaped partition board including an upper horizontal board and a lower horizontal board, with a vertically extending middle vertical board interconnecting the upper horizontal board and lower horizontal board;

wherein the upper horizontal board respectively divide the interior of the installation shell into a blowing chamber and a suction chamber located at opposite sides of the upper horizontal board, and a side of the middle vertical board defines an exchange chamber within the installation shell, with the blowing chamber and exchange chamber, as well as the suction chamber and exchange chamber respectively separated by the middle vertical board;

wherein the external air port is connected with the exchange chamber, the middle vertical board is provided with an inflation port connected with the blowing chamber and a discharge port connected with the suction chamber, and the L-shaped switching pipe is selectively connectable with the discharge port and inflation port through different displacement positions;

wherein the fan includes a centrifugal impeller mounted in the blowing chamber, with a suction end at a center of the centrifugal impeller being connected with the suction chamber;

wherein a side of the lower horizontal board away from the exchange chamber defines a collection chamber within the installation shell, with the main chamber supply port and each secondary chamber supply port being simultaneously connected with the collection chamber;

wherein the lower horizontal board comprises a vertical tube connected with the collection chamber, and the inflation port and discharge port are linearly arranged along an extension direction of the vertical tube;

wherein one end of the L-shaped switching pipe is slidably received within the vertical tube and is connected with the collection chamber to allow the L-shaped switching pipe to perform linear reciprocating movement along the vertical tube to different positions so as to make the other end of the L-shaped switching pipe selectively connect with the inflation port and discharge port, and wherein the lower horizontal board is integrally formed with a supplemental tube, through which the exchange chamber is in fluid communication with the suction chamber;

wherein when the L-shaped switching pipe is connected with the inflation port, a port of the supplemental tube within the exchange chamber is in an open state, and when the L-shaped switching pipe is connected with the discharge port, a bottom surface of the L-shaped switching pipe covers and seals the port of the supplemental tube within exchange chamber.

6. The line-controlled air pump according to claim 5, wherein a top of the upper horizontal board is integrally formed with a first annular board, which extends vertically to an inner wall of the installation shell and encloses to define the blowing chamber together with the inner wall of the installation shell, and the upper horizontal board is provided with a communication hole in fluid communication with the blowing chamber and suction chamber; and wherein the fan further includes a motor, the motor and centrifugal impeller are respectively positioned in the suction chamber and blowing chamber and are coaxially connected through the communication hole.

7. The line-controlled air pump according to claim 6, wherein a motor mounting plate corresponding to the communication hole is provided within the suction chamber, which is spaced at a predetermined distance from a bottom of the upper horizontal board;

wherein a plurality of connecting plates are fixedly connected between the upper horizontal board and the motor mounting plate, which are arranged around a center axis of the communication hole and spaced with a predetermined gap between each other; and wherein the motor mounting plate is provided with a plurality of screw holes, and a shaft hole configured for an output shaft of the motor to pass through.

8. The line-controlled air pump according to claim 5, wherein a bottom of the lower horizontal board is integrally formed with a second annular board, which extends vertically to an inner wall of the installation shell to define the collection chamber together with the inner wall of the installation shell.

9. A method for controlling the line-controlled air pump according to claim 1, comprising steps of inflating the main chamber and all secondary chambers of the inflatable product:

opening, by the control system, the main chamber valve and secondary chamber valves;

activating the fan and simultaneously switching the L-shaped switching pipe to establish fluid communication with the discharge end of the fan to drive external air to enter inside of the pump through the external air port, and then through the L-shaped switching pipe to respectively enter the main chamber supply port and each secondary chamber supply port, so as to achieve inflation of the main chamber and the secondary chambers of the inflatable product;

detecting, by the pressure sensor, the pressure data inside the inflatable product during the inflation process, determining that if the pressure data has risen to a preset first threshold, if yes, closing, by the control system, each secondary chamber valve to stop inflation of each secondary chamber of the inflatable product, while maintaining the main chamber valve in an open state to continue inflation of the main chamber of the inflatable product;

determining that if the pressure data has risen to a preset second threshold, if yes, closing, by the control system, the main chamber valve to stop inflation of the main chamber of the inflatable product, while reopening, by the control system, each secondary chamber valve to continue inflation of each secondary chamber of the inflatable product; and determining that if the pressure data has risen to a preset third threshold, if yes, inactivating, by the control system, the fan and closing each secondary chamber valve to stop inflation of both the main chamber and each secondary chamber of the inflatable product.

10. The method according to claim 9, comprising steps of deflating the main chamber and all secondary chambers of the inflatable product:

opening, by the control system, the main chamber valve and secondary chamber valves;

activating the fan and simultaneously switching the L-shaped switching pipe to establish fluid communication with the suction end of the fan to drive air from the main chamber and each secondary chamber of the inflatable product to enter the L-shaped switching pipe through the main chamber supply port and each secondary chamber supply port and further enter the air pump, so as to be discharged through the external air port of the air pump;

detecting, by the pressure sensor, the pressure data inside the inflatable product to be inflated during the deflation process; and determining that if the pressure data has dropped to a preset fourth threshold, if yes, closing, by the control system, the main chamber valve and secondary chamber valves and inactivating the fan.

11. The method according to claim 9, comprising steps of increasing the air pressure in the main chamber or secondary chambers of the inflatable product after inflation is complete:

activating, by the control system, the fan and switching the L-shaped switching pipe to establish fluid communication with the discharge end of the fan;

opening the main chamber valve or secondary chamber valves to drive external air through the L-shaped switching pipe to enter the main chamber supply port or secondary chamber supply ports, so as to continuously inflate the main chamber or secondary chambers of the inflatable product; and inactivating, by the control system, the fan and closing the main chamber valve or secondary chamber valves after inflation is complete.

12. The method according to claim 9, comprising steps of decreasing the air pressure in the main chamber or secondary chambers of the inflatable product after inflation is complete:

opening, by the control system, the main chamber valve or secondary chamber valves to allow air from the main chamber or secondary chambers of the inflatable product to enter the inside of the air pump through the L-shaped switching pipe, and be naturally discharged through the external air port.

13. A method for controlling the line-controlled air pump according to claim 12, comprising steps of inflating the main chamber and all secondary chambers of the inflatable product: opening, by the control system, the main chamber valve and secondary chamber valves; activating the fan and simultaneously switching the L-shaped switching pipe to establish fluid communication with the discharge end of the fan to drive external air to enter inside of the pump through the external air port, and then through the L-shaped switching pipe to respectively enter the main chamber supply port and each secondary chamber supply port, so as to achieve inflation of the main chamber and the secondary chambers of the inflatable product; detecting, by the pressure sensor, the pressure data inside the inflatable product during the inflation process, determining that if the pressure data has risen to a preset first threshold, if yes, closing, by the control system, each secondary chamber valve to stop inflation of each secondary chamber of the inflatable product, while maintaining the main chamber valve in an open state to continue inflation of the main chamber of the inflatable product; determining that if the pressure data has risen to a preset second threshold, if yes, closing, by the control system, the main chamber valve to stop inflation of the main chamber of the inflatable product, while reopening, by the control system, each secondary chamber valve to continue inflation of each secondary chamber of the inflatable product; and determining that if the pressure data has risen to a preset third threshold, if yes, inactivating, by the control system, the fan and closing each secondary chamber valve to stop inflation of both the main chamber and each secondary chamber of the inflatable product.

14. The method according to claim 13, comprising steps of deflating the main chamber and all secondary chambers of the inflatable product: opening, by the control system, the main chamber valve and secondary chamber valves; activating the fan and simultaneously switching the L-shaped switching pipe to establish fluid communication with the suction end of the fan to drive air from the main chamber and each secondary chamber of the inflatable product to enter the L-shaped switching pipe through the main chamber supply port and each secondary chamber supply port and further enter the air pump, so as to be discharged through the external air port of the air pump; detecting, by the pressure sensor, the pressure data inside the inflatable product to be inflated during the deflation process; and determining that if the pressure data has dropped to a preset fourth threshold, if yes, closing, by the control system, the main chamber valve and secondary chamber valves and inactivating the fan.

15. The method according to claim 13, comprising steps of increasing the air pressure in the main chamber or secondary chambers of the inflatable product after inflation is complete: activating, by the control system, the fan and switching the L-shaped switching pipe to establish fluid communication with the discharge end of the fan; opening the main chamber valve or secondary chamber valves to drive external air through the L-shaped switching pipe to enter the main chamber supply port or secondary chamber supply ports, so as to continuously inflate the main chamber or secondary chambers of the inflatable product; and inactivating, by the control system, the fan and closing the main chamber valve or secondary chamber valves after inflation is complete.

16. The method according to claim 13, comprising steps of decreasing the air pressure in the main chamber or secondary chambers of the inflatable product after inflation is complete: opening, by the control system, the main chamber valve or secondary chamber valves to allow air from the main chamber or secondary chambers of the inflatable product to enter the inside of the air pump through the L-shaped switching pipe, and be naturally discharged through the external air port.

* * * * *